US005258899A

United States Patent [19]

Chen

[11] Patent Number: 5,258,899

[45] Date of Patent: Nov. 2, 1993

[54] MOTION SENSOR LIGHTING CONTROL

[76] Inventor: Kent Chen, 5th Fl., No. 16, Lane 130, Min Chuan Rd., Hsin Tien City, Taipei Hsien, Taiwan

[21] Appl. No.: 978,799

[22] Filed: Nov. 19, 1992

[51] Int. Cl.[5] ..... F21S 1/14

[52] U.S. Cl. ..... 362/394; 362/419; 362/421; 362/802

[58] Field of Search ..... 362/269, 276, 287, 394, 362/419, 421, 427, 802; 248/288.3, 288.5

[56] References Cited

U.S. PATENT DOCUMENTS

| | | | |
|---|---|---|---|
| 1,494,821 | 5/1924 | Stearns | 362/421 |
| 2,617,619 | 11/1952 | Versen | 362/421 |
| 4,333,132 | 6/1982 | Paley | 362/421 |
| 4,357,651 | 11/1982 | Mayer | 362/427 |
| 4,811,181 | 3/1989 | Jones | 362/287 |
| 4,881,154 | 11/1989 | Tseng et al. | 362/802 |

*Primary Examiner*—Richard R. Cole
*Assistant Examiner*—Y. Quach
*Attorney, Agent, or Firm*—Peterson, Wicks, Nemer & Kamrath

[57] ABSTRACT

A motion sensor lighting control includes a hemispherical mounting plate having a pair of first circular apertures and a second circular aperture, a pair of lamp holders for receiving lamps therein rotatably mounted on the first circular apertures by a pair of first swivel devices, a sensor housing for receiving an infrared sensor rotatably mounted on the second circular aperture by a second swivel devices. The first swivel devices and the second swivel device are such arranged to let the lamp holders and the sensor housing to be manually rotated in universal orientations, yet limiting the rotation angle to be less than 360 degrees thus preventing the wires therein to be twisted and broken.

15 Claims, 5 Drawing Sheets

MOTION SENSOR LIGHTING CONTROL

FIELD OF THE INVENTION

The present invention relates to a motion sensor lighting control for mounting at least one floodlight or the like.

BACKGROUND OF THE INVENTION

Motion sensor lighting controls have been known for years. One conventional motion sensor lighting control is shown in FIG. 5. The conventional motion sensor lighting control has an infrared sensor box 50, a pair of lamp holders 60, and a mounting plate 70 for rotatably engaging the sensor box 50 and the lamp holders thereto. A first ball joint 51 extending from one end of the sensor box 50 is engaged to a tube 56 which has a second ball joint 52 which further engages to a ball joint, 53. The ball joint 53 is secured to the mounting plate 70 by a lock nut 54. Each lamp holder 60 is also secured to the mounting plate 70 by a lock nut 61. Electrical wires 62 are arranged through the lamp holder 60 to the inner space of the mounting plate 70. Electrical wires 55 are arranged from the sensor box 50, via the tube 56, the ball joint 52 to the inner space of the mounting plate 70. The lamp holder 60 can rotate in universal directions because of two joints 61 and 61'. The sensor box 50 can have universal rotation, but the wires 55 might be twisted and broken by continuous rotation.

It is the purpose of the present invention, therefore, to mitigate and/or obviate the above-mentioned drawbacks in the manner set forth in the detailed description of the preferred embodiment.

SUMMARY OF THE INVENTION

An integral, preassembled prewired motion sensor lighting control, according to the present invention, comprises a mounting plate having a pair of first circular apertures and a second circular aperture, a pair of first swivel means for engaging a pair of lamp holder to the first circular apertures and allowing the lamp holder to rotate in universal angles but limiting each rotation angle to less than 360 degrees for preventing the wires therein to be twisted and broken, a second swivel means for engaging a sensor housing to the second circular aperture and allowing the sensor housing to rotate in universal angles but limiting each rotation angle to less than 360 degrees for preventing the wires therein to be twisted and broken.

An object of the present invention is to provide, a motion sensor lighting control which has a pair of lamp holder and a sensor housing rotatably mounted on a mounting plate such that the lampholders and the sensor housing can be manually swiveled in universal angles and be adjusted to a desired orientation relationship.

Another object of the present invention is to provide a motion sensor lighting control which has a pair of lamp holder and a sensor housing rotatably mounted on a mounting plate and are arranged such that the lamp holder and the sensor housing can be manually swiveled to any desired relationship without twisting and breaking the wires therein.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
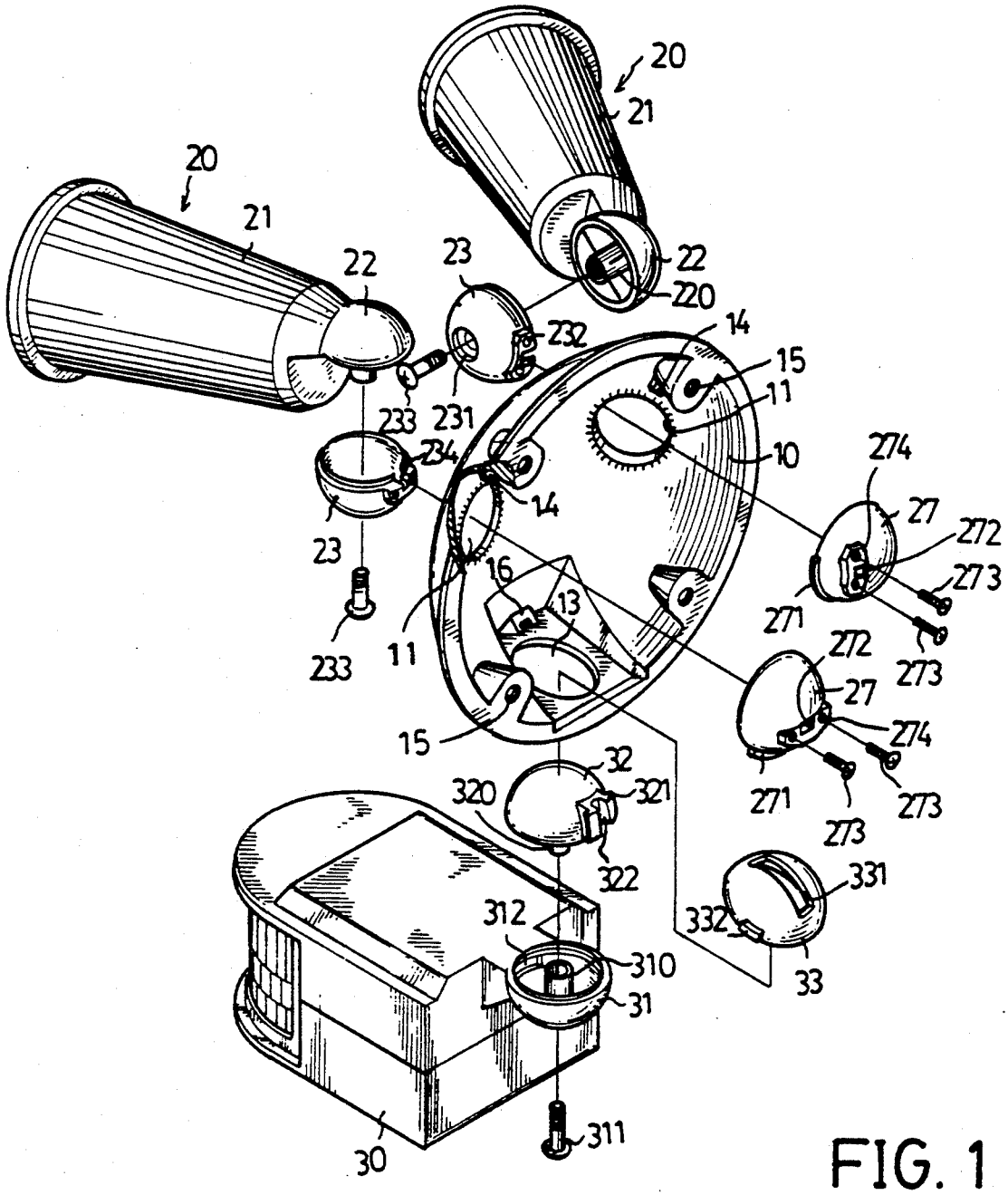
FIG. 1 is an exploded view of a motion sensor lighting control in accordance with the present invention.

Referring to the drawings in general and FIG. 1 in particular, a motion sensor lighting control apparatus comprises a pair of lamp holders 20, each for receiving a floodlight therein, a mounting plate 10 for establishing electrical and mechanical connections with a source of electrical power, a pair of first swivel means 23 and 27 for engaging the lamp holders 20 to the mounting plate 10 and allowing the lamp holders 20 to swivel with respect to the mounting plate 10, a sensor housing 30 for receiving motion sensor electronics therein, and a second swivel means 33 and 32 for engaging the sensor housing 30 to the mounting plate 10 and allowing the sensor housing 30 to swivel in respect to the mounting plate 10. The first swivel means includes a first hemispherical member 27 and a second hemispherical member 23. The second swivel means includes a third hemispherical member 33 and a fourth hemispherical member 32.

The lamp holder 20 has a tube portion 21 having an open end for receiving a floodlight or the like and a first hemispherical portion 22 extending from another end of the tube portion 21 for engaging to the first swivel means which includes a first hemispherical member 27 and a second hemispherical member 23, as will be described in more detail. A lamp socket (not shown) is installed in the tube portion 21 for receiving a lamp (not shown). The first hemispherical portion 22 is in communication with an inner space of the tube portion 21, thereby allowing electrical wires to pass from the tube portion 21 to the first swivel means.

The mounting plate 10 comprises a pair of first circular apertures 11, a second circular aperture 13, and four holes 15 at the periphery thereof. Each first aperture 11 receives the first hemispherical portion 22 of the lamp holder 20 and the second hemispherical member 23 of the first swivel means therethrough, while allowing the first hemispherical portion 22 and the second hemispherical member 23 to swivel therein. The second circular aperture 13 receives the second hemispherical portion 31 and the fourth hemispherical member 32 of the second swivel means, while allowing the second hemispherical portion 31 and the fourth hemispherical member 32 to swivel therein. The four holes 15 are used to cooperate with four bolts (not shown) to install the motion sensor lighting control on an electrical outlet junction box or the like.

Figure 3:
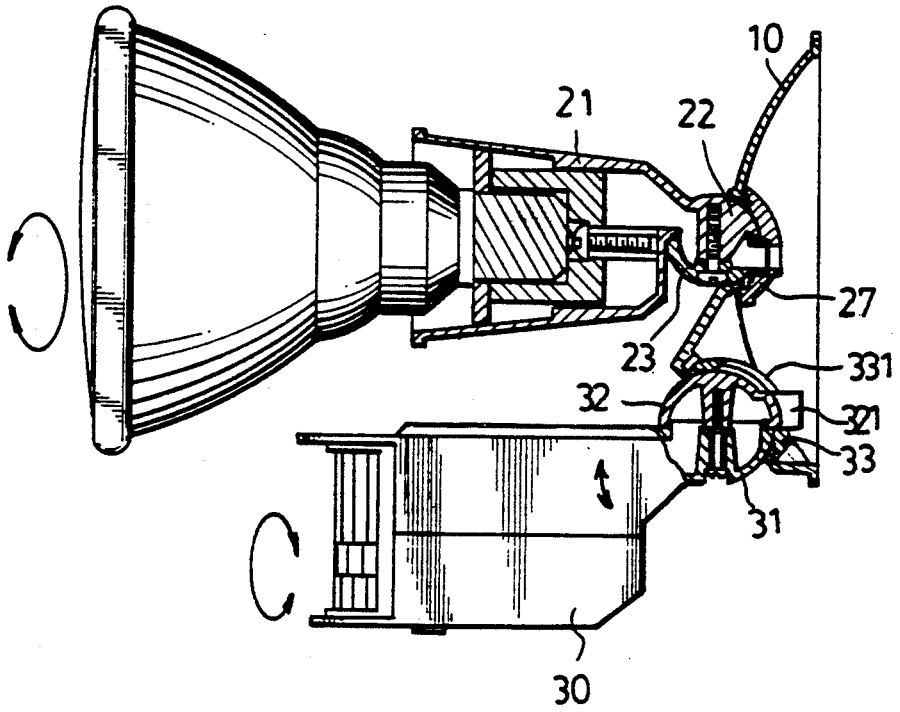
FIG. 3 is a sectional view of FIG. 2.

Referring to FIGS. 1 and 3, the first hemispherical member 27 of the first swivel means has a diameter greater than a diameter of the first circular aperture 11. The second hemispherical member 23 of the first swivel means has a diameter greater than the diameter of the first circular aperture 11 for preventing the passage thereof through the first circular aperture 11. The first hemispherical member 27 has a first engaging portion 274 including two holes through the top surface thereof. The second hemispherical member 23 and the first hemispherical portion 22 have the same diameter, such that both can be incorporated to a ball. The second hemispherical member 23 has a second engaging portion 232 including two holes (not labeled) in the circle edge thereof. The second hemispherical member 23 of the first swivel means has a hole 231 and the first hemispherical portion 22 of the lamp holder 20 has a corresponding first tubular socket 220 which is threaded after a bolt 233 is fastened to engage the second hemispherical member 23 to the first hemispherical portion 22 of the lamp holder 20, while permitting the first hemispherical portion 22 to rotate with respect to the second hemispherical member 23. The second hemispherical member 23 is engaged to the first hemispherical member 27 by a pair of screws 273.

Once the first hemispherical portion 22 engages to the second hemispherical member 23, which further engages to the first hemispherical member 27, the circle edge of the first hemispherical member 27 is rotatably engaged against the periphery of the first circular aperture 11, the first hemispherical portion 22 of the lamp holder 20 is rotatably engaged to the second hemispherical member 23 and also received in the first hemispherical member 27. The rotation axis of the first hemispherical member 27 is perpendicular to the rotation axis of the first hemispherical portion 22.

The sensor housing 30 has a second hemispherical portion 31 extending from one side thereof. The second hemispherical portion 31 is in communication with the inner space of the sensor housing 30 by a slot 312 therebetween, such that the electrical wires are allowed to pass from the housing 30 to the second hemispherical portion 31. A second tubular socket 310 is formed at the axis of the second hemispherical portion 31 for engaging to the fourth hemispherical member 32 of the second swivel means as will be described in more detail later.

Referring to FIGS. 1 and 3, the third hemispherical member 33 of the second swivel means has an arcuate slot 331 at the central top portion thereof. The fourth hemispherical member 32 of the second swivel means has a sliding/engaging portion 321 on the circle edge thereof. The third hemispherical member 33 has a diameter greater than a diameter of the second circular aperture 13 for preventing the passage thereof through the second circular aperture 13. The fourth hemispherical member 32 has a diameter greater than the diameter of the second circular aperture 13. The fourth hemispherical member 32 partially penetrates the second circular aperture 13 and is received in the third hemispherical member 33 while the sliding/engaging portion 321 thereof is engaged to and slidable along periphery of the arcuate slot 331 of the third hemispherical member 33. The circle edge of the third hemispherical member 33 is rotatably engaged against the periphery of the second circular aperture 13. A third tubular socket 320 is formed at the axis of fourth hemispherical member 32 of the second swivel means. The third tubular socket 320 is received in the second tubular socket 310. A fourth bolt 311 is used to secure the second tubular socket 310 to the third tubular socket 320. The second hemispherical portion 31 of the sensor housing 30 and the fourth hemispherical member 32 has a same diameter, such that both can be incorporated to a ball. The second hemispherical portion 31 of the sensor housing 30 is rotatably engaged to the fourth hemispherical member 32 and also received in the third hemispherical member 33. Once the second hemispherical portion 31 engages to the fourth hemispherical member 32 which further engages to the third hemispherical member 33, the circle edge of the third hemispherical member 33 is rotatably engaged against the periphery of the second circular aperture 13, the engaging/sliding portion 321 of the fourth hemispherical member 32 is slidable along the arcuate slot 331 of the third hemispherical member 33 causing the same rotation effect of the fourth hemispherical member 32 to rotate inside the third hemispherical member 33, the second hemispherical portion 31 of the sensor housing 30 is rotatably engaged to the fourth hemispherical member 32 of the second swivel means. The rotation axis of the third hemispherical member 33, the rotation axis of the fourth hemispherical member 32, and the rotation axis of the second hemispherical portion 31 are perpendicular to each other.

For establishing a wire passage from the lamp holder 20 through the first swivel means, the second swivel means, to the sensor housing 30, a slot 234 is formed at the second engaging portion 232 of the second hemispherical member 23, a slot 272 is formed at the first engaging portion 274 of the first hemispherical member 27, and a slot 322 is formed at the sliding/engaging portion 32 of the fourth hemispherical member 32.

However, the rotation of the first and the second swivel means may cause the wires to be twisted and broken or shortened. Therefore, the first hemispherical member 27 has a first arcuate flange portion 271 protruding from the circle edge thereof, and the periphery of the first circular aperture 11 has a first stop 14 protruding therefrom to stop the first arcuate flange portion 271 when the first hemispherical member 27 rotates, thereby limiting the first hemispherical member 27 to a rotation to less than 360 degrees either in clockwise or counter-clockwise orientation. Similarly, the third hemispherical member 33 has a second arcuate flange portion 332 protruding from the circle edge thereof, and the periphery of the second circular aperture 13 has a second stop 16 protruding therefrom to stop the second arcuate flange portion 332 when the third hemispherical member 33 rotates, thereby limiting the third hemispherical member 33 to a rotation to less than 360 degrees either in clockwise and counter-clockwise orientation.

Figure 2:
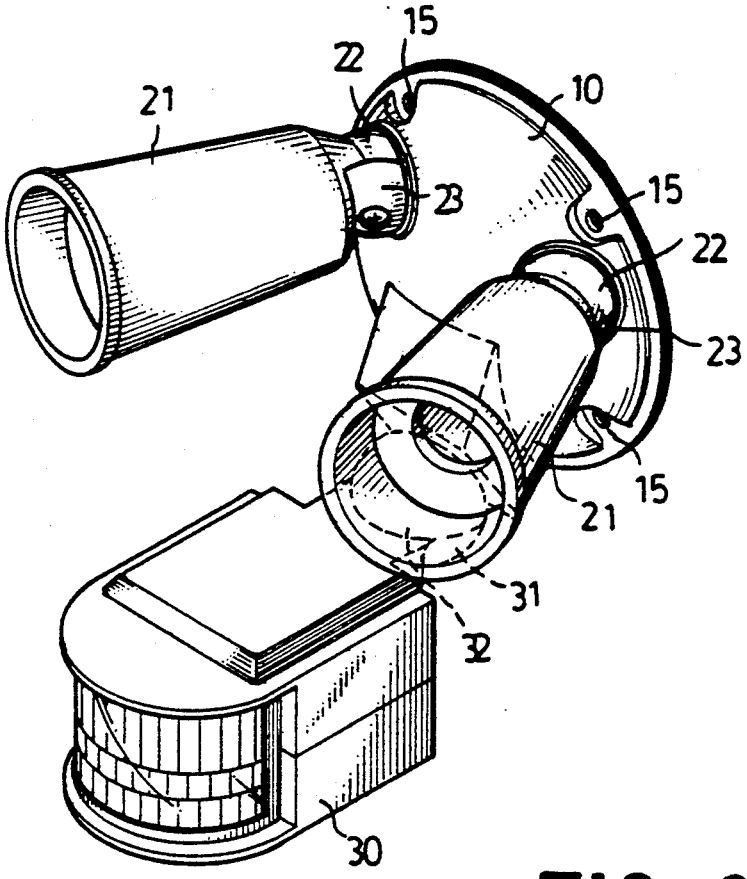
FIG. 2 is an assembly outlook of FIG. 1.
Figure 4:
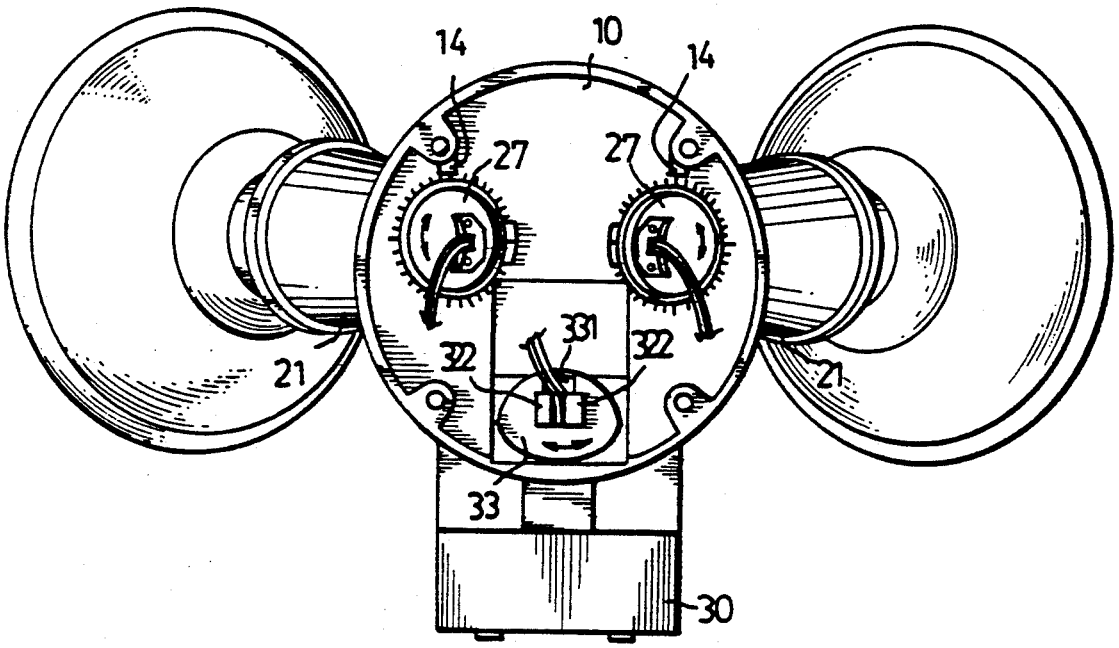
FIG. 4 is a rear view of the motion sensor lighting control of the present invention.
Figure 5:
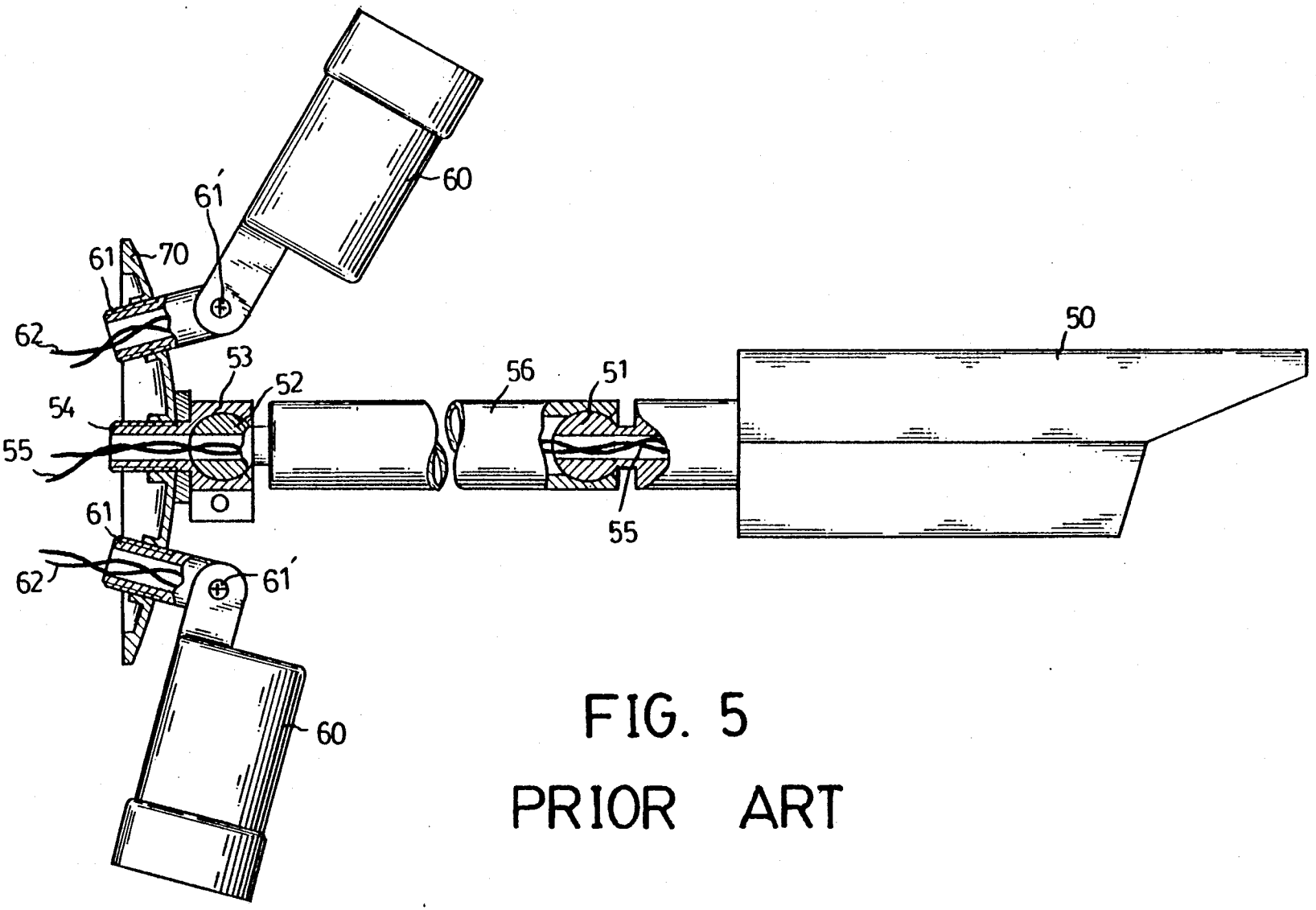
FIG. 5 PRIOR ART
FIG. 5 is a sectional view of a conventional motion sensor lighting control.

FIG. 2 illustrates the spatial relationship of the motion sensor lighting control of the present invention. FIG. 4 illustrates a rear view of FIG. 2 and also shows the electrical wires passing the swivel means to the inner space of the mounting plate 10. Actually, a waterproof washer (not shown) can be installed inside the first hemispherical member 27 for preventing from water entering. Of course, another water-proof washer (not shown) can also be installed inside the third hemispherical member for water proof.

While the present invention has been explained in relation to its preferred embodiment, it is to be understood that various modifications thereof will be apparent to those skilled in the art upon reading, this specification. Therefore, it is to be understood that the invention disclosed herein is intended to cover all such modifications as fall within the scope of the appended claims.

What is claimed:

1. A motion sensor lighting control apparatus comprising:

at least lamp holder (20) having a tube portion (21) for receiving a floodlight or the like and a first hemispherical portion (22) extending from one end of said tube portion (21);

a substantially hemispherical base (10), having at least a first circular aperture (11) and a second circular aperture (13);

at least a first swivel means (23 and 27) comprising a first hemispherical member (27) and a second hemispherical member (23), said first hemispherical member (27) having a diameter greater than a diameter of said first circular aperture (11), said second hemispherical member (23) having a diameter greater than the diameter of the first circular aperture (11) for preventing the passage thereof through the first circular aperture (11), said second hemispherical member (23) having an engaging portion (232) in a circle edge thereof for being received in and engaged to an inner surface of said first hemispherical member (27) while a circle edge of said first hemispherical member (27) being rotatably engaged against the periphery of said first circular aperture (11), said first hemispherical portion (22) of said lamp holder (20) being rotatably engaged to said second hemispherical member (23) and also received in said first hemispherical member (27);

a sensor housing (30) for receiving a sensor therein having a second hemispherical portion (31) extending from one side thereof; and a second swivel means (33 and 32) comprising a third hemispherical member (33) which has an arcuate slot (331) at a top surface thereof and a fourth hemispherical member (32) which has a sliding/engaging portion (321), said third hemispherical member (33) having a diameter greater than a diameter of said second circular aperture (13), said fourth hemispherical member (32) having a diameter greater than the diameter of said second circular aperture (13) for preventing the passage through said second circular aperture (13), said fourth hemispherical member (32) being received in said third hemispherical member (33) while said sliding/engaging portion (321) thereof engages to and is slidable along periphery of said arcuate slot (331) of said third hemispherical member (33) and a circle edge of said third hemispherical member (33) is rotatably engaged against the periphery of said second circular aperture (13), said second hemispherical portion (31) of said sensor housing (30) being rotatably engaged to said fourth hemispherical member (32) and also received in said third hemispherical member (33).

2. A motion sensor lighting control as claimed in claim 1, wherein said second hemispherical member (23) of said first swivel means has a hole (231), said first hemispherical portion (22) of said lamp holder (20) has a first tubular socket (220) which is threaded after a bolt (233), (231) through the hole is fastened to engage said second hemispherical member (23) to said first hemispherical portion (22) of said lamp holder (20).

3. A motion sensor lighting control as claimed in claim 1, wherein said tube portion (21) of said lamp hold is in communication with said first hemispherical portion (22), said second hemispherical member (23) has a second slot (234) in the engaging portion (232) thereof, said first hemispherical member (27) also has a first slot (274) in the inner surface thereof, causing said tube portion (21) to be in communication with an inner space of said base (10) and allowing electrical wires to pass from said tube portion (21) to the inner space of said base (10).

4. A motion sensor lighting control as claimed in claim 1, wherein said second hemispherical portion (31) of said sensor housing (30) has a third slot (312) communicating with said sensor housing (30), said sliding/engaging portion (321) also has a fourth slot (322) for being in communicating with an inner space of said base (10), causing said sensor housing (30) to be in communication with the inner space of said base (10) and allowing electrical wires to pass from said sensor housing (30) to the inner space of said base (10).

5. A motion sensor lighting control as claimed in claim 1, wherein said first hemispherical member (27) has an arcuate flange portion (271) protruding from the circle edge thereof, said periphery of said first circular aperture (11) has a first stop (14) protruding therefrom, limiting said first hemispherical member (27) to a rotation of less than 360 degrees.

6. A motion sensor lighting control as claimed in claim 1, wherein said third hemispherical member (33) has a second arcuate flange portion (332) protruding from the circle edge thereof, the periphery of said second circular aperture (13) has a second stop (16) protruding therefrom, limiting said third hemispherical member (33) to a rotation of less than 360 degrees.

7. A motion sensor lighting control as claimed in claim 1, wherein said fourth hemispherical member (32) of said second swivel means has a third tubular socket (320) and formed at an axis thereof, said second hemispherical portion (31) of said sensor housing (30) has a second tubular socket (310) formed at the axis thereof for receiving said third tubular socket (320) and allowing said second hemispherical portion (31) to rotate with respect to said fourth hemispherical member (32).

8. A motion sensor lighting control apparatus comprising:

at least a lamp holder (20) having a tube portion (21) for receiving a floodlight and a first hemispherical portion (22) extending from one end of said tube portion (21);

a substantially hemispherical base (10), having at least a first circular aperture (11) and a second circular aperture (13); and at least a first swivel means (23 and 27) comprising a first hemispherical member (27) and a second hemispherical member (23), said first hemispherical member (27) having a diameter greater than a diameter of said first circular aperture (11), said second hemispherical member (23) having a diameter greater than the diameter of the first circular aperture (11) for preventing the passage thereof through the first circular aperture (11), said second hemispherical member (23) having an engaging portion (232) in a circle edge thereof for being received in and engaged to an inner surface of said first hemispherical member (27) while a circle edge of said first hemispherical member (27) being rotatably engaged against the periphery of said first circular aperture (11), said first hemispherical portion (22) of said lamp holder (20) being rotatably engaged to said second hemispherical member (23) and also received in said first hemispherical member (27).

9. A motion sensor lighting control as claimed in claim 8, wherein said second hemispherical member

(23) of said first swivel means has a hole (231), said first hemispherical portion (22) of said lamp holder (20) has a first tubular socket (220) which is threaded after a bolt (233), (231) through the hole is fastened to engage said second hemispherical member (23) to said first hemispherical portion (22) of said lamp holder (20).

10. A motion sensor lighting control as claimed in claim 8, wherein said tube portion (21) of said lamp holder is in communication with said first hemispherical portion (22), said second hemispherical member (23) has a second slot (234) in the engaging portion (232) thereof, said first hemispherical member (27) also has a first slot (274) in the inner surface thereof, causing said tube portion (21) to be in communication with an inner space of said base (10) and allowing electrical wires to pass from said tube portion (21) to the inner space of said base (10).

11. A motion sensor lighting control as claimed in claim 8, wherein said first hemispherical member (27) has an arcuate flange portion (271) protruding from the circle edge thereof, said periphery of said first circular aperture (11) has a first stop (14) protruding therefrom, limiting said first hemispherical member (27) to a rotation of less than 360 degrees.

12. A motion sensor lighting control apparatus comprising:

a substantially hemispherical base (10), having at least a first circular aperture (11) and a second circular aperture (13);

a sensor housing (30) for receiving a sensor therein having a hemispherical portion (31) extending from one side thereof;

a swivel means (33 and 32) comprising a first hemispherical member (33) which has an arcuate slot (331) at a top surface thereof and a second hemispherical member (32) which has a sliding/engaging portion (321), said first hemispherical member (33) having a diameter greater than a diameter of said second circular aperture (13), said second hemispherical member (32) having a diameter greater than the diameter of said second circular aperture (13) for preventing the passage thereof through said second circular aperture (13), said second hemispherical member (32) being received in said first hemispherical member (33) while said sliding/engaging portion (321) thereof engages to and is slidable along periphery of said arcuate slot (331) of said first hemispherical member (33) and a circle edge of said first hemispherical member (33) is rotatably engaged against the periphery of said second circular aperture (13), said hemispherical portion (31) of said sensor housing (30) being rotatably engaged to said second hemispherical member (32) and also received in said first hemispherical member (33).

13. A motion sensor lighting control as claimed in claim 12, wherein said hemispherical portion (31) of said sensor housing (30) has a first slot (312) communicating with said sensor housing (30), said sliding/engaging portion (321) also has a second slot (322) for being in communicating with an inner space of said base (10), causing said sensor housing (30) to be in communication with the inner space of said base (10) and allowing electrical wires to pass from said sensor housing (30) to the inner space of said base (10).

14. A motion sensor lighting control as claimed in claim 12, wherein said first hemispherical member (33) has an arcuate flange portion (332) protruding from the circle edge thereof, the periphery of said second circular aperture (13) has a stop (16) protruding therefrom, limiting said first hemispherical member (33) to a rotation of less than 360 degrees.

15. A motion sensor lighting control as claimed in claim 12, wherein said second hemispherical member (32) of said swivel means has a first tubular socket (320) and formed at an axis thereof, said hemispherical portion (31) of said sensor housing (30) has another tubular socket (310) formed at the axis thereof for receiving said first tubular socket (320) and allowing said hemispherical portion (31) to rotate with respect to said second hemispherical member (32).

* * * * *